United States Patent [19]

Leiter et al.

[11] 4,320,266

[45] Mar. 16, 1982

[54] SWITCH FOR COMBINED HEATER PLUG OR IGNITION AND STARTING CIRCUITS IN A MOTOR VEHICLE

[75] Inventors: Heinz Leiter, Gemmrigheim; Rudi Plog, Bietigheim-Bissingen, both of Fed. Rep. of Germany

[73] Assignee: Merit-Werk Merten & Co. KG, Gummersbach, Fed. Rep. of Germany

[21] Appl. No.: 102,950

[22] Filed: Dec. 12, 1979

[30] Foreign Application Priority Data

Dec. 13, 1978 [DE] Fed. Rep. of Germany ..... 2853681

[51] Int. Cl.[3] ..... H01H 9/00

[52] U.S. Cl. ..... 200/4; 200/11 C; 200/153 LB

[58] Field of Search ..... 200/11 C, 44, 153 L, 200/153 LB, 155 R, 273, 4

[56] References Cited

U.S. PATENT DOCUMENTS 2,604,554 7/1952 Jacobi ..... 200/44 X 2,715,661 8/1955 Miller ..... 200/44 X

FOREIGN PATENT DOCUMENTS 2555110 6/1977 Fed. Rep. of Germany .

*Primary Examiner*—J. V. Truhe
*Assistant Examiner*—Morris Ginsburg
*Attorney, Agent, or Firm*—Michael J. Striker

[57] ABSTRACT

A multiposition switch for ignition or heater plug and starter circuits in a motor vehicle, adapted for an independent switching of a plurality of load circuits, includes a switching disk rotatable about an axis and supporting spring biased conductive arms crossing each other and being bent in the crossing region into a U-shaped configuration so that the arms are insulated one from the other. One end of each arm sweeps on a plurality of stationary load contacts whereas the other end portion of respective arms is controlled by annular cams surrounding the load contacts. A stationary counter-contact ring is provided in the region between the rotary axis and the load contacts and cooperates with contact studs secured to respective arms.

14 Claims, 6 Drawing Figures

SWITCH FOR COMBINED HEATER PLUG OR IGNITION AND STARTING CIRCUITS IN A MOTOR VEHICLE

BACKGROUND OF THE INVENTION

The invention relates to a switch for combined heater plug or ignition and starting circuits and for independent switching of a plurality of load circuits, the switch being of the type which includes at least two spring biased contact arms arranged in a rotary driver or switching wheel, the arms being insulated one from the other and each cooperating at one end thereof with annular cams; the cams lift and lower during the rotation of the arms contact studs attached to the arms opposite a counter-contact ring which is fixed around the axis of rotation of the arms on a socket of the switch; a plurality of load contacts are mounted in the socket around the counter-contact and cooperate with the other end portions of the arms.

A known switch of this type for controlling the ignition circuit in a motor vehicle is known from the German published patent application No. 2,555,110 and includes a socket having a central contact and a plurality of load contact terminals arranged about the central contact. The driver or switching disk of the switch supports a bridging element which is permanently connected to the central contact via a contacting stud of a double contact member which is aligned with axis of the switch and biased by a spring. The double contact member has a finger which sweeps across the load contacts. In addition, the driver or switching disk supports a switching bridge having a contact arm abutting against a shaped contact member. The shaped contact member can be raised and lowered into engagement with another contact stud of the double contact member and has a contact arm which also sweeps across the individual load contact terminals.

Similar switches for the ignition circuits of motor vehicles are described in the German utility model applications Nos. 6,801,832 and 7,310,447 and are also based on the aforedescribed conventional designs utilizing a single liftable switching bridge. Provided that such known designs are intended for switching additional circuits, it would be necessary to provide a further liftable switching bridge on the driver or switching wheel and this double switching bridge arrangement would haved to be coupled via a connecting piece to the central contact and to one of the contact studs of the double contact member and to act with its switching arm on an additional profiled contact piece, whereby the contact surface of this additional switching bridge would have to cooperate as a lifting contact with the counter-contact on the socket of the switch.

In the known switches of this type all current is fed to the central contact and all contact members of respective load circuits are of necessity directed to this center contact arranged in the axis of rotation of the switch.

Such a prior art design of switches having several superposed central contacts arranged along the rotary axis however, has the disadvantage that each of the employed contact studs must be designed for a relatively long switching trip in order to avoid a premature or a completely unintended contact and to ensure a proper switching action. Difficulties arise however when an excessive clearance between the respective switching studs takes place inasmuch as the control of contact arms supporting the contact studs is effect by means of cam disks concentrically arranged on the housing of the switch around its rotary axis. The limited space within the housing permits, however, only a limited pitch of such cam plates between the individual stop points of the switch and consequently the pitch of the cams and thus the lift or trip of the controlled contact studs cannot exceed a predetermined value. Moreover, a conventional switch of this type is oversized in axial direction and this is again disadvantageous for the design of stop cams between the driver or switching wheel and the housing of the switch; these stop cams cooperate with spring biased drop-in pins normally arranged on the driver or switching wheel.

Since the cam rings for controlling the axial movement of contact arms are arranged on the periphery of the socket for the switch housing and have, consequently, only a limited length, there arise difficulties when an increased number of load circuits is to be successively switched on by means of contacts arranged side-by-side in small angular increments.

SUMMARY OF THE INVENTION

It is therefore a general object of the present invention to overcome the aforementioned disadvantages.

More particularly, it is an object of the invention to provide a switch of the aforedescribed type for combined heater plus/or ignition and starting circuits of a motor vehicle which is reduced in size in axial direction and which permits an increased number of switching positions at smaller angular spacings than have conventional switches of similar design.

Another object of this invention is to provide such an improved switch which is reliable in operation and which is easy to manufacture.

In keeping with these objects, and others which will become apparent hereafter, one feature of the invention resides, in a switch of the aforedescribed type, in the provision of at least two conductive arms crossing each other substantially in a single plane and having their overlapping regions in the range of the rotary axis of the switch shaped into substantially U-shaped configuration with oppositely directed bridging portions; each of the arms is provided with contact studs radially offset with respect to the rotary axis and cooperating with a stationary counter-contact in the form of a contact ring arranged around the rotary axis.

By virtue of the oppositely bent U-shaped regions of the arms of this invention crossing each other in a common plane and having contact studs radially offset from the axis of rotation of the switch and cooperating with a stationary counter-contact ring which is arranged concentrically to the axis of rotation opposite the contact studs, an important advantages is attained in that the resulting switch is suitable for a multiple switching action of several independent load circuits. The counter-contact ring can be designed such as to connect the contact arms synchronously or independently from one another. Inasmuch as the contact arms have no central contacts, they can be arranged more closely one above the other along the rotary axis of the switch without the danger of faulty switching action.

The conductive contact arms in the switch of this invention may also have an increased radial length in comparison with conventional switches and consequently the control cam or camplates in the socket of the switch have an increased peripheral length. This increased length of control cams in turn facilitates number of switching positions at smaller angular distances.

According to another feature of this invention, each contact arm cooperates with a holding contact arranged on the same level as the radially offset contact studs and which is controlled by additional cams to be lifted from the counter-contact ring. The rotary driver or switching wheel of the switch accommodates spring biased drop-in pins which are engageable into recesses in grinding grooves provided in the housing or in the socket of the switch. In this manner an increased stop moment for the driver is attained and the production of the arresting means for the driver having a plurality of stop positions is facilitated.

The novel features which are considered as characteristic for the invention are set forth in particular in the appended claims. The invention itself, however, both as to its construction and its method of operation, together will additional objects and advantages thereof, will be best understood from the following description of specific embodiments when read in connection with the accompanying drawing.

DESCRIPTION OF THE PREFERRED EMBODIMENTS

Figure 1:
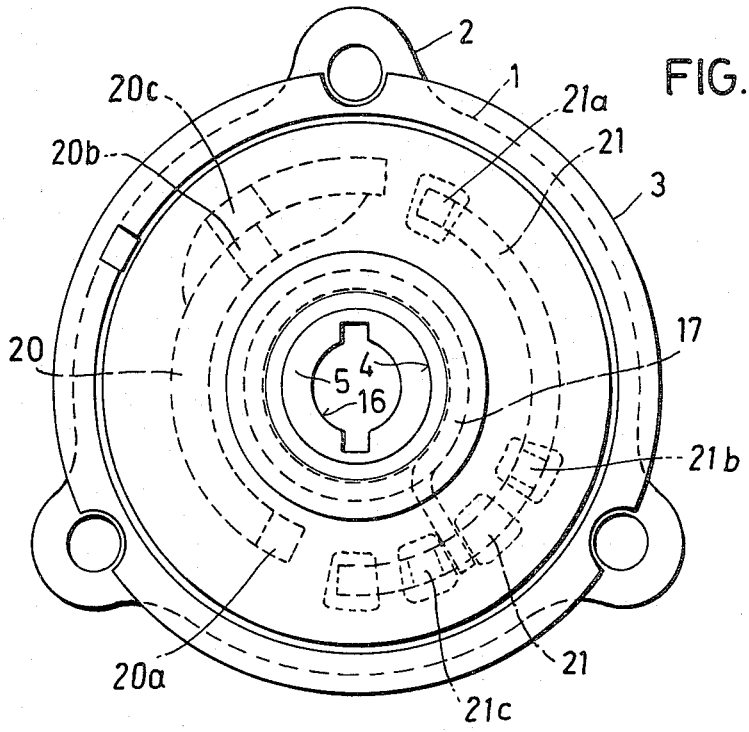
FIG. 1 is a top view of the switch of this invention.

The example of the switch of this invention as illustrated in the Figures is suitable for controlling combined ignition or heater plug and starting circuits in a motor vehicle which is also suitable for independent closing of a plurality of other load circuits.

The switch includes a socket 1 having radially outwardly directed mounting eyes 2. The upper part of socket 1 is closed by a cover 3 which accommodates a rotary driver or switching disk 5 having an upwardly directed tubular projection supported for rotation in a cylindrical bearing 4 in the cover 3.

Figure 2:
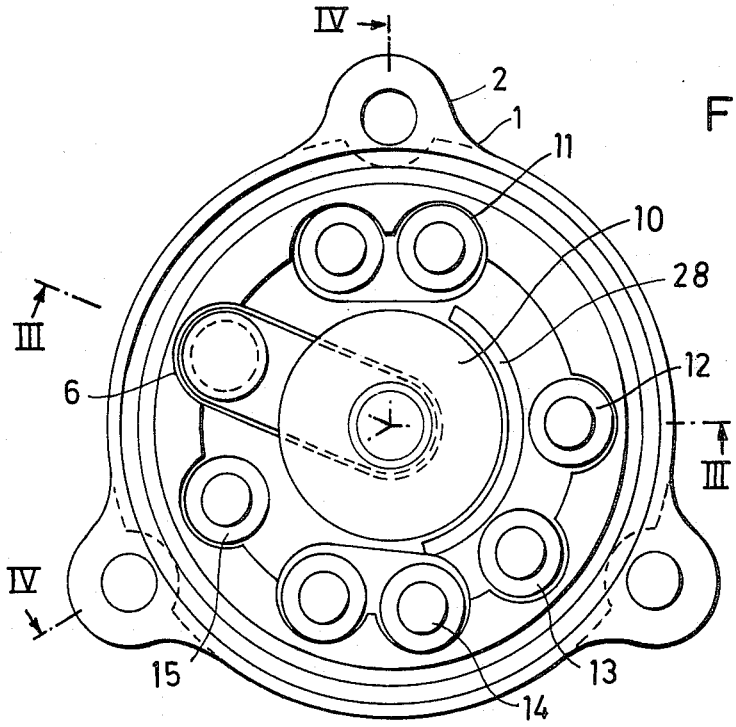
FIG. 2 is a bottom view of the switch of FIG. 1.

The base of the socket 1 supports a plurality of stationary contact terminals 6, 7 and 8 which project downwardly to be connected to individual load circuits. Contact terminal 6 is connected to a counter-contact ring 10 which is arranged concentrically around the rotary axis 9 of the disk 5 whereas the remaining contact terminals 7, 8 and additional nonillustrated contact terminals are connected to corresponding load contacts 11 through 15 distributed on the upper surface of socket 1 around the stationary contact ring 10 (FIG. 2). The tubular bearing projection of the driver or switching disk 5 has an axial recess 16 for receiving a cylindrical key or the like control element by means of which it is operated in the housing 3 against the force of a helical spring 17 located in the housing cover 3 and surrounding the projecting bearing portion of the driver 5.

Two spring biased drop-in pins 18 and 19 are arranged in blind bores in the upper surface of the driver or switching wheel 5. The projecting free ends of the pins 18 and 19 are guided in annular grooves 20 and 21 (FIGS. 1 and 2) provided with a plurality of stop recesses 20*a*, 20*b*, 20*c* and 21*a*, 21*b*, 21*c*, releasably engageable by the pins 18 and 19 to define predetermined switching positions of the rotary disk 5. These stop recesses have arcuate cross sections so that the spring biased pins disengage the latter when the driver or switching disk 5 is rotated by the actuation element.

Figure 3:
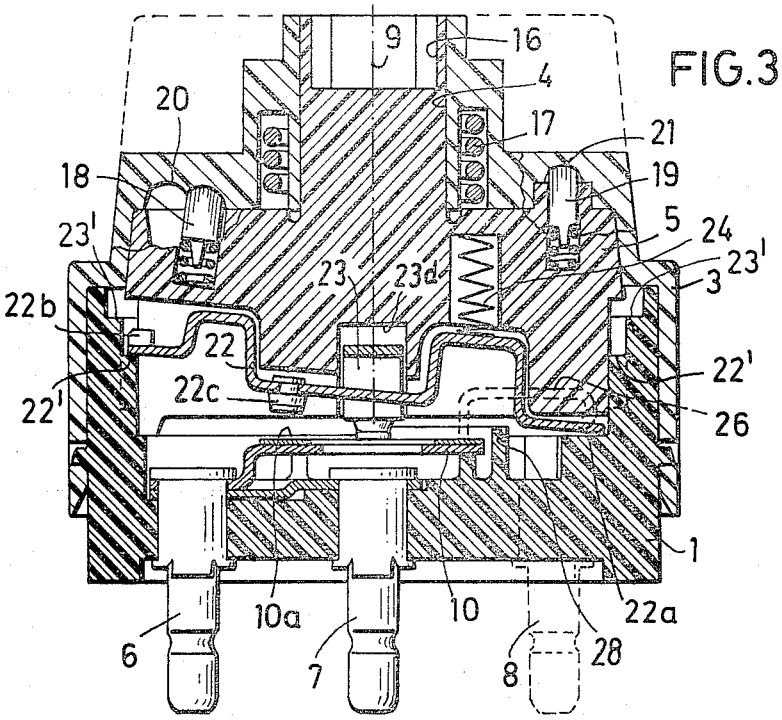
FIG. 3 is an axial section taken along the line III—III of FIG. 2.

The bottom surface of the driver or switching disk 5 is formed with two intersecting grooves 22*d* and 23*d* for holding in position two contact arms 22 and 23 arranged substantially in a single plane and cross each other in the region of the rotary axis 9 of the disk 5. According to one feature of this invention, these two arms are bent in this region into a U-shaped configuration oriented in opposite directions so that the two arms are insulated one from the other. Each arm is subject to a biasing force exerted by pressure springs 24 and 25 lodged in the switching disk 5 opposite the raised portions of the U-shaped contact arms 22 and 23. One of the end portions of respective contact arms, namely the right hand portions 22*a* and 23*a* as illustrated in FIGS. 3 an 4 are urged by the biasing springs 24 and 25 to slide on the contact surfaces of the load contacts 11 and 15 fixed in the base of socket 1. The other end portions of respective contact arms 22 and 23, namely the left hand end portions are provided with control pieces 22*b* and 23*b* which slide on assigned annular cams 22' and 23' which in this example are formed in the inner wall of the socket 1. The annular cams 22' and 23' encircle the load contact surfaces 11 through 15 and are concentric with the rotary axis 9. Both cams 22' and 23' are stepwise staggered relatived to each other to extend on two axially and radially different planes.

Figure 4:
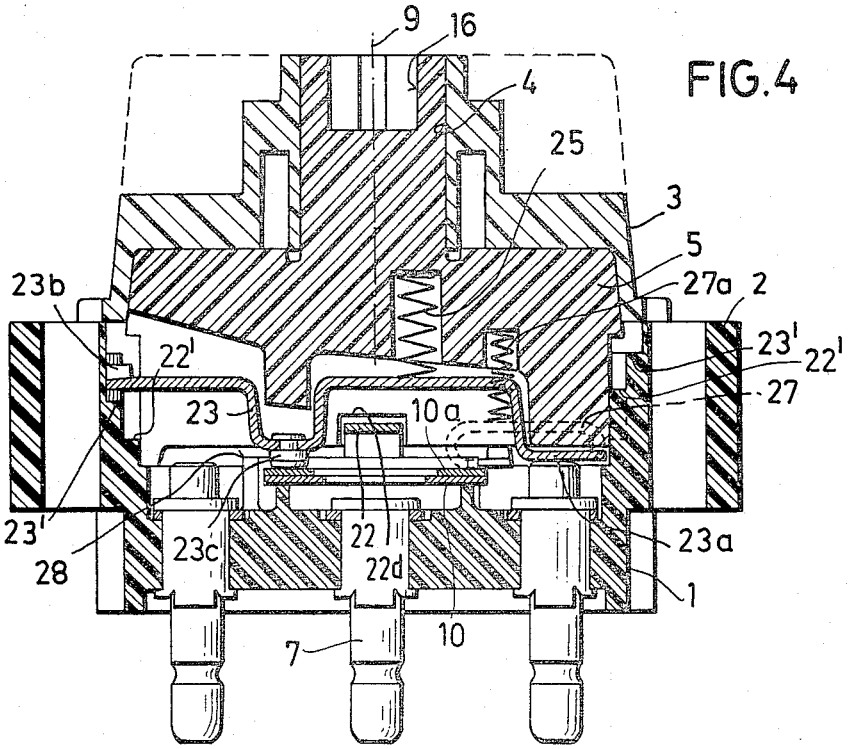
FIG. 4 is an axial section taken on the line IV—IV of FIG. 2.
Figure 5:
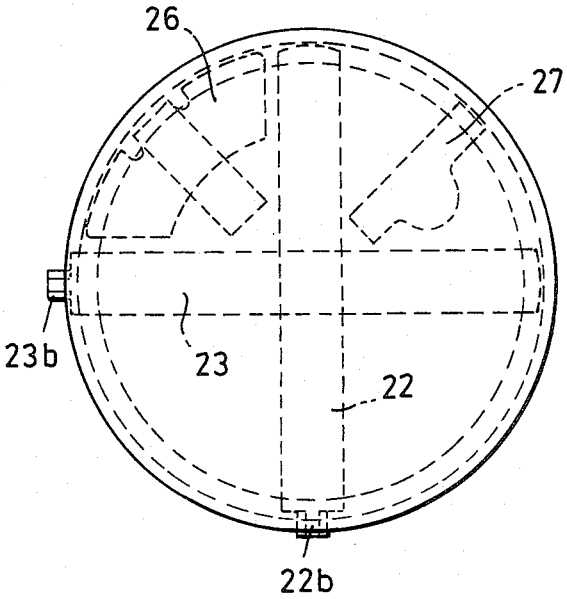
FIG. 5 is a schematic bottom view of crossing contact arms and of holding contacts arranged in the rotary driver or switching wheel of the switch.

The stationary countercontact ring 10 which is fixed by means on contact terminal 6 (FIG. 3) to the socket 1 between the load contacts 11 through 15 and the axis of rotation, is coated with a suitable contact layer 10*a* located opposite contact studs 22*c* and 23*c* on respective contact arms 22 and 23. When the switching disk 5 is rotated, the end portions 22*b* and 23*b* are lifted or lowered on the assigned annular cams 22' and 23' and so are the contact studs 22*c* and 23*c*. In this manner, contact studs are selectively lowered into contact with the countercontact ring 10 while the other end portion 22*a* and 23*a* are always urged by springs 24 and 25 against the load contact surfaces 11 through 15. It will be noted that contrary to prior art solutions in the design of this invention there is no common central contact but instead the contact studs 22*c* and 23*c* are radially offset from the rotary axis 9. As seen in FIG. 3 to 5, the switching disk 5 supports in addition to contact arms 22 and 23 two holding contacts 26 and 27 projecting inwardly against the inner contact ring 10 and being controlled by additional cam sections 28 of which only one is illustrated in FIG. 2.

These additional cam sections 28 for controlling the holding contacts 26 and 27 to disengage the ring 10, are also concentric relative to the rotary axis 9 and extend between the axis 9 and the load contact surfaces 11 through 15. The countercontact ring 10 as well as the surfaces of studs 22*c* and 23*c* are preferably silver plated; nonetheless they can be coated with any suitable layer of contacting material which is capable of withstanding the high current loads occuring in the ignition and starting circuits of a motor vehicle.

Figure 4A:
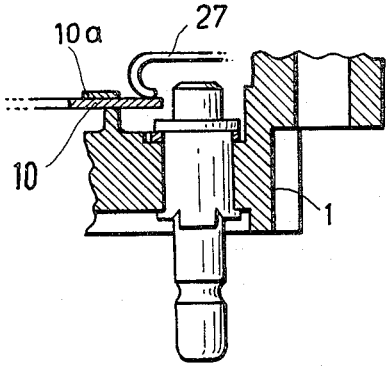
FIG. 4*a* is a sectional view of a cut-away part of a modification of FIG. 4.

The holding contacts 26 and 27 are either spring loaded by springs 27*a* or are made of a resilient material and can slide directly on the ring 10 or outside its coating 10*a* to counteract the forces applied against the disk 5. It is preferred that the projecting ends of holding contacts 26 and 27 are located outside the contact ring 10 (FIG. 4*a*) in order to prevent the damage of the contact coating 10*a*.

It will be understood that each of the elements described above, or two or more together, may also find a useful application in other types of constructions differeing from the types described above.

While the invention has been illustrated and described as embodied in a specific example of the multiposition switch, it is not intended to be limited to the details shown, since various modifications and structural changes may be made without departing in any way from the spirit of the present invention.

For example, instead of providing the guiding grooves 20 and 21 for the drop-in pins 18 and 19 on the inner wall of the cover 3 of the switch housing, it is possible to provide such guiding grooves on the bottom of the socket 1. Or in variation, it is also possible to form the guidng grooves for the drop-in pins on the rotary driver or switching disk 5 whereas the corresponding drop-in pins are arranged either on the bottom of the socket 1 or on the top part of the cover 3.

Without further analysis, the foreging will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A multiposition rotary switch for separate load circuits, particularly ignition and starter circuits in a motor vehicle, comprising at least two mutually insulated conductive arms crossing each other and being supported for joint rotation about a common axis and each being movable in axial direction, said arms defining two end portions, respectively; a plurality of load contacts arranged around said axis in the path of rotary movement of one end portion of respective arms to engage periodically the same; at least a pair of stationary cams arranged around said axis outside load contacts, said cams continuously engaging the other end portion of respective arms to lift and lower adjoining parts of said arms during their rotation; contact elements formed on the axially movable parts of said arms between said axis and said other end portions; and stationary counter-contact means concentrically arranged around said axis opposite said contact elements to engage the latter at predetermined angular positions of said arms.

2. The switch as defined in claim 1 further including a socket defining a base and cylindrical wall, said load contacts and said counter-contact means being arranged in said base andd said cams being formed in said cylindrical wall.

3. The switch as defined in claim 2 further including a cover secured to said socket and supporting for rotation about said axis a rotary member, the lower part of said rotary member supporting said conductive arms, and means for resiliently urging said arms against said cams and said load contacts in said socket.

4. The switch as defined in claim 3 wherein the region of crossing of said arms is bent into a substantially U-shaped configuration having bridging portions spaced apart one from the other whereby said one end portion of said arms and said load contacts are arranged in a single plane.

5. The switch as defined in claim 4 wherein said cams are stepwise staggered relative to each other.

6. The switch as defined in claim 4 further including holding contacts supported on said rotary member and engaging said counter-contact means at the same level as said contact elements of said arms.

7. The switch as defined in claim 6 further including additional cams arranged between said counter-contact means and said load contacts to control said holding contacts.

8. The switch as defined in claim 7 wherein said additional cams for said holding contacts are concentric to said rotary axis.

9. The switch as defined in claim 4 wherein said counter-contact means and said contact elements of said arms are coated with a contacting layer.

10. The switch as defined in claim 9 wherein said counter-contact means and said contact elements are silver plated.

11. The switch as defined in claim 7 wherein said holding contacts are of resilient material.

12. The switch as defined in claim 7 wherein said holding contacts are spring loaded.

13. The switch as defined in claim 9 wherein holding contacts engage said countercontact means outside said contacting layer.

14. The switch as defined in claim 4 further including, between said rotary member and said cover, spring loaded drop-in pins and guiding grooves with a plurality of stop recesses for said pins.

* * * * *